US012312666B2

(12) United States Patent
Hättestrand et al.

(10) Patent No.: US 12,312,666 B2
(45) Date of Patent: May 27, 2025

(54) FERRITIC IRON-CHROMIUM-ALUMINUM POWDER AND A SEAMLESS TUBE MADE THEREOF

(71) Applicant: KANTHAL AB, Hallstahammar (SE)

(72) Inventors: Mats Hättestrand, Sandviken (SE); Roger Berglund, Hallstahammar (SE); Martin Östlund, Sandviken (SE)

(73) Assignee: Kanthal AB, Hallstahammar (SE)

( * ) Notice: Subject to any disclaimer, the term of this patent is extended or adjusted under 35 U.S.C. 154(b) by 0 days.

(21) Appl. No.: 18/707,639

(22) PCT Filed: Nov. 10, 2022

(86) PCT No.: PCT/SE2022/051052
§ 371 (c)(1),
(2) Date: May 6, 2024

(87) PCT Pub. No.: WO2023/086006
PCT Pub. Date: May 19, 2023

(65) Prior Publication Data

US 2024/0337004 A1 Oct. 10, 2024

(30) Foreign Application Priority Data

Nov. 11, 2021 (SE) ..... 2130303-7

(51) Int. Cl.

| | |
|---|---|
| ***C22C 38/50*** | (2006.01) |
| ***B22F 3/15*** | (2006.01) |
| ***B22F 5/10*** | (2006.01) |
| ***B22F 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/44*** | (2006.01) |

(52) U.S. Cl.
CPC ..... *C22C 38/50* (2013.01); *B22F 3/15* (2013.01); *B22F 5/106* (2013.01); *B22F 9/082* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/26* (2013.01); *C22C 38/44* (2013.01); *B22F 2009/0824* (2013.01); *B22F 2301/35* (2013.01); *B22F 2998/10* (2013.01); *B22F 2999/00* (2013.01)

(58) Field of Classification Search
None
See application file for complete search history.

(56) References Cited

U.S. PATENT DOCUMENTS

| | | | |
|---|---|---|---|
| 2003/0089198 | A1 | 5/2003 | Berglund et al. |
| 2004/0131493 | A1 | 7/2004 | Hattendorf et al. |
| 2007/0041862 | A1 | 2/2007 | Hattendorf et al. |
| 2011/0031235 | A1 | 2/2011 | Hattendorf |
| 2020/0360978 | A1 | 11/2020 | Rave et al. |

FOREIGN PATENT DOCUMENTS

| | | | |
|---|---|---|---|
| JP | H09-228008 | A | 9/1997 |
| JP | 2002-105606 | A | 4/2002 |

OTHER PUBLICATIONS

International Search Report and Written Opinion dated Dec. 22, 2022, issued in corresponding International Patent Application No. PCT/SE2022/051052.
Office Action dated Aug. 19, 2024, issued in corresponding Korean Patent Application No. 10-2024-7015654.

*Primary Examiner* — Anthony M Liang
(74) *Attorney, Agent, or Firm* — Morgan, Lewis & Bockius LLP

(57) ABSTRACT

The present disclosure relates to a ferritic iron-chromium-aluminium (FeCrAl) powder which will provide seamless tubes of said powder and therefore will have a combination of good formability and form stability, good oxidation resistance and creep resistance. The present disclosure also relates to a seamless tube comprising a FeCrAl alloy. The FeCrAl powder comprises the following elements in weight %: Balance Fe and unavoidable impurities Al 4.0 to 6.0 0.01 to 0.10 Hf 0.05 to 0.25 O 0.01 to 0.04 Cr 19.0 to 23.0 Ta 0.01 to 0.40 Ti 0.01 to 0.15 C 0.01 to 0.05 N 0.01 to 0.10 Si Max 0.50 Mn Max 0.30 Zr 0.05 to 0.20 fulfilling the condition of: $2*[Y]-3*[O]<0$, wherein the number of [Y] and [O] are in atom %.

17 Claims, No Drawings

FERRITIC IRON-CHROMIUM-ALUMINUM POWDER AND A SEAMLESS TUBE MADE THEREOF

TECHNICAL FIELD

The present disclosure relates to a ferritic iron-chromium-aluminum (FeCrAl) powder which will provide an object composed of said powder with a combination of good formability, form stability, oxidation resistance and creep resistance. The present disclosure also relates to a seamless tube comprising a FeCrAl alloy which has been manufactured from said powder.

BACKGROUND

Iron-chromium-aluminium (FeCrAl) alloys which are manufactured from FeCrAl powders having a chromium (Cr) content of 15 to 25 wt % and an aluminum (Al) content from 3 to 6 wt % are well known for their ability to form protective α-alumina ($Al_2O_3$), aluminum oxide scales when exposed to temperatures between 90° and 1300° C. These alloys are good in applications wherein there is a need for good oxidation resistance.

However, even though it is possible to obtain tubes of these powder compositions, the process of obtaining crack free seamless tubes is very cumbersome due to the issue of formability.

It is therefore an aspect of the present disclosure to provide a FeCrAl powder which, when used in a process for manufacturing an object, such as a seamless tube, will provide the object with a combination of good formability, form stability, oxidation resistance and creep resistance and therefore also reduce or even eliminate the formation of cracks during the manufacturing process

SUMMARY

The present disclosure therefore provides a ferritic iron-chromium-aluminum (FeCrAl) powder having a composition which has been optimized for providing an object, such as a tube, such as a seamless tube, with excellent mechanical properties, good creep strength, good oxidation resistance and which will provide for that essentially no cracks are formed during the manufacturing process. This is possible because the present power will provide any object made thereof with excellent ductility, such as both excellent hot and cold ductility, and thereby excellent formability.

The FeCrAl powder according to the present disclosure is characterized in that it has the following composition (in weight %):

| Balance | Fe and unavoidable impurities |
|---|---|
| Al | 4.0 to 6.0 |
| Y | 0.01 to 0.10 |
| Hf | 0.05 to 0.25 |
| O | 0.01 to 0.04 |
| Cr | 19.0 to 23.0 |
| Ta | 0.01 to 0.40 |
| Ti | 0.01 to 0.15 |
| C | 0.01 to 0.05 |
| N | 0.01 to 0.10 |
| Si | Max 0.50 |
| Mn | Max 0.30 |
| Zr | 0.05 to 0.20 |

and fulfilling the requirement of:

2*[Y]−3*[O]<0 wherein the number of [Y] and [O] are in atom % (at %).

By fulfilling both these element ranges and the above requirement, any excess of yttrium in relation to oxygen will be avoided and thereby will the formation of detrimental phases be avoided, such as the formation of $Fe_{17}Y_2$, which is detrimental for hot ductility. Furthermore, it has been shown that if this requirement is fulfilled, an object obtained from said powder will have both excellent hot ductility and cold ductility.

DETAILED DESCRIPTION

The present disclosure relates to a FeCrAl powder characterized in that it has the following composition in weight % (wt %):

| Balance | Fe and unavoidable impurities |
|---|---|
| Al | 4.0 to 6.0 |
| Y | 0.01 to 0.10 |
| Hf | 0.05 to 0.25 |
| O | 0.01 to 0.04 |
| Cr | 19.0 to 23.0 |
| Ta | 0.01 to 0.40 |
| Ti | 0.01 to 0.15 |
| C | 0.01 to 0.05 |
| N | 0.01 to 0.10 |
| Si | Max 0.50 |
| Mn | Max 0.30 |
| Zr | 0.05 to 0.20 |

and fulfilling the requirement of:

2*[Y]−3*[O]<0 wherein the number of [Y] and [O] are in atom %.

The present disclosure also relates to a FeCrAl powder characterized in that it has the following composition in weight % (wt %):

| Balance | Fe and unavoidable impurities |
|---|---|
| Al | 4.0 to 6.0 |
| Y | 0.01 to 0.10 |
| Hf | 0.05 to 0.25 |
| O | 0.01 to 0.03 |
| Cr | 19.0 to 23.0 |
| Ta | 0.01 to 0.20 |
| Ti | 0.01 to 0.10 |
| C | 0.01 to 0.05 |
| N | 0.01 to 0.10 |
| Si | Max 0.50 |
| Mn | Max 0.30 |
| Zr | 0.05 to 0.20 |

And fulfilling the requirement of:

2*[Y]−3*[O]<0 wherein the number of [Y] and [O] are in atom %.

The present disclosure also relates to an object comprising an alloy having the following composition in weight % (wt %):

| Balance | Fe and unavoidable impurities |
|---|---|
| Al | 4.0 to 6.0 |
| Y | 0.01 to 0.10 |

-continued

| Balance | Fe and unavoidable impurities |
|---|---|
| Hf | 0.05 to 0.25 |
| O | 0.01 to 0.04 |
| Cr | 19.0 to 23.0 |
| Ta | 0.01 to 0.40 |
| Ti | 0.01 to 0.15 |
| C | 0.01 to 0.05 |
| N | 0.01 to 0.10 |
| Si | Max 0.50 |
| Mn | Max 0.30 |
| Zr | 0.05 to 0.20 |

and fulfilling the requirement of:

2*[Y]−3*[O]<0 wherein the number of [Y] and [O] are in atom %.

The present disclosure also relates to an object comprising an alloy having the following composition in weight % (wt %):

| Balance | Fe and unavoidable impurities |
|---|---|
| Al | 4.0 to 6.0 |
| Y | 0.01 to 0.10 |
| Hf | 0.05 to 0.25 |
| O | 0.01 to 0.03 |
| Cr | 19.0 to 23.0 |
| Ta | 0.01 to 0.20 |
| Ti | 0.01 to 0.10 |
| C | 0.01 to 0.05 |
| N | 0.01 to 0.10 |
| Si | Max 0.50 |
| Mn | Max 0.30 |
| Zr | 0.05 to 0.20 |

And fulfilling the requirement of:

2*[Y]−3*[O]<0 wherein the number of [Y] and [O] are in atom %.

The object may be a tube, such as a seamless tube.

The inventors have thus surprisingly found that it is essential that the requirement 2*[Y]−3*[O]<0 is fulfilled because if this requirement is fulfilled together with the above mentioned element ranges, then there will be an excess of oxygen in relation to yttrium which will ensure that an object or an object manufactured from the said powder will have excellent ductility, both hot and cold ductility. This will lead to that an object, for example a seamless tube, will be very easy to manufacture as it will have a combination of good formability and form stability, and also that the obtained object will essentially have no cracks and good oxidation resistance and creep resistance.

The alloying elements according to the present disclosure will now be described in more detail. The terms "weight %" and "wt %" are used interchangeably. Also, the list of properties or contributions mentioned for a specific element should not be considered exhaustive.

Iron (Fe)

The main function for iron in the FeCrAl powder is to balance the composition.

Chromium (Cr) 19.0 to 23.0 wt %

Chromium is an important element since it will improve the corrosion resistance and increase the tensile and yield strength. Further, chromium facilitates the formation of the $Al_2O_3$ layer on the surface through the so-called third element effect, i.e., by formation of chromium oxide in the transient oxidation stage. Too low amount of chromium will result in loss of corrosion resistance. Thus, chromium shall be present an amount of at least 19.0 wt %, such as at least 20.0 wt %. Too much chromium will enable a to decompose to a' and also enable 475° C. embrittlement and will also lead to an increased solid solutioning hardening effect on the ferritic structure. Thus, the maximum content of chromium is set to 23.0 wt %, such as maximum 22.0 wt %. According to embodiments, the Cr content is from 19 to 23 wt %, such as from 20 to 22 wt %.

Aluminum (Al) 4.0 to 6.0 wt %

Aluminum is an important element since aluminum, when exposed to oxygen at high temperatures, will form a dense and thin $Al_2O_3$ layer on the surface, which will protect the underlying surface from further oxidation. Further, aluminum increases the electrical resistivity. At too low amounts of aluminum, the electrical resistivity will be reduced, and there will be a loss of the ability for the formation of $Al_2O_3$ layer and thereby the oxidation resistance will be reduced. Thus, aluminum shall be present in an amount of at least 4.0 wt %, such as at least 4.5 wt %. Too high content of aluminum will cause brittleness at low temperatures and will also enhance the formation of unwanted brittle aluminides. Thus, the maximum aluminum is set to 6.0 wt %, such as maximum 5.5 wt %. According to embodiments, the Al content is 4.0 to 6.0 wt %, such as from 4.5 to 5.5 wt %.

Titanium (Ti) 0.01-0.15 wt %

Titanium is added in order to bind any free carbon or nitrogen. The content is from 0.01 to 0.15 wt %, such as 0.01 to 0.10 wt %.

Nitrogen (N) 0.01-0.10 wt %

Nitrogen is included to increase strength by precipitation hardening. At too high levels, nitrogen may have a negative effect on the corrosion resistance. Therefore, the maximum amount of nitrogen is 0.10 wt %. According to embodiments, the content of N is 0.02-0.08 wt %, such as 0.02 to 0.06 wt %.

Zirconium (Zr) 0.05-0.20 wt %

Zirconium is an important element as zirconium will reduce the activity of C and N by the formation of ZrC or ZrN precipitates. Zirconium will also improve the high temperature creep strength. Too low amount of Zr will increase the risk of the formation of unwanted carbides. Accordingly, zirconium shall be present in an amount of at least 0.05 wt %, such as at least 0.08 wt %, such as at least 0.10 wt %. On the other hand, too high content of zirconium may have a negative impact on the formation of $Al_2O_3$. For these reasons, the maximum content of zirconium is set to 0.20 wt %, such as maximum 0.17 wt %.

Yttrium (Y) 0.01 to 0.10 wt %

Yttrium is added to improve the oxidation resistance. However, too high content of yttrium will cause hot embrittlement. Further, too high content of yttrium will enhance the formation of clusters of yttrium oxide which will cause embrittlement and thus poor hot and cold formability. As a result, the maximum content of yttrium content is set to 0.10 wt %, such as max 0.07 wt %, such as max 0.06 wt %, such as max 0.05 wt %.

Carbon (C) 0.01 to 0.05 wt %

Carbon is added to increase strength by precipitation hardening. Too high content of carbon may result in difficulties to form the material and will also have a negative effect on the corrosion resistance. Therefore, the maximum amount of carbon is 0.05 wt %.

Silicon (Si)≤0.50 wt %

Silicon is present in levels of ≤0.50 wt % in order to increase electrical resistivity and corrosion resistance. However, above this level, the hardness will increase and also there will be brittleness at low temperatures.

Oxygen (O) 0.01-0.04 wt %

Oxygen is present in the form of oxides. The maximum content allowed is ≤0.04 wt %. According to embodiments, the maximum content of oxygen is ≤0.03. The inventors have surprisingly found that by having an excess of oxygen in relation to Y, the formation of brittle phases will be reduced which will improve the hot ductility.

Hafnium (Hf) 0.05 to 0.30 wt %

Hafnium is included in the present powder in order to bind any free nitrogen or carbon, which otherwise affect corrosion resistance negatively. According to embodiments, the content of Hf is 0.05 to 0.30 wt %, such as 0.05 to 0.25 wt %, such as 0.15 to 0.25 wt %.

Tantalum (Ta) 0.01 to 0.30 wt %

Tantalum is included in order to bind any free nitrogen or carbon, which otherwise would affect corrosion resistance negatively. According to embodiments, the content of Ta is 0.01 to 0.20 wt %, such as 0.01 to 0.20 wt %.

Mangan (Mn) Max 0.30 wt %

Manganese is an optional alloying element. A too high content of Mn will reduce the formation of the alumina layer. Accordingly, the content of Mn is set at maximum 0.30 wt %.

Furthermore, the inventors have found that it is important that the present powder also fulfills the condition of:

$$2*Y-3*O<0 \text{ wherein all the values are atom \%}$$

The present requirement is important as by fulfilling this requirement there will be an excess of oxygen in relation to yttrium. This excess will ensure that have excellent ductility, both hot and cold. Furthermore, this will reduce the risk of formation of yttrium oxide clusters and stringers in the object. According to embodiment, $2*Y-3*O<-0.10$, such as $<-0.15$ According to embodiments, the powder or the object may also include minor fractions of one or more of the following impurity elements such as but not limited to: Magnesium (Mg), Nickel (Ni), Cerium (Ce), Calcium (Ca), Phosphorus (P), Tungsten (W), Cobalt (Co), Sulphur(S), Molybdenum (Mo), Niobium (Nb), Vanadium (V) and Copper (Cu). By impurity elements are meant that they are present due to productions methods and/or material used in the manufacture process but they are present in such small amounts that they do not affect the properties.

Additionally, the FeCrAl powder or FeCrAl object as defined hereinabove or hereinafter may comprise the alloying elements mentioned herein in any of the ranges mentioned herein. According to one embodiment, the present powder or object consists of all the alloying elements mentioned herein, in any of the ranges mentioned herein.

Furthermore, another aspect of the present disclosure is to provide tube, such as a seamless tube, which have good mechanical properties and essentially no cracks and which can be manufactured through rolling. However, the present powder as defined hereinabove or hereinafter may also be used for manufacturing a wire or a sheet or a strip or the like.

The FeCrAl powder as defined hereinabove or hereinafter may be manufactured through different methods. For example, but not limited to:

- directly by gas atomization;
- heating a powder comprising all the alloying element in the ranges mentioned hereinabove or hereinafter;
- mixing a powder comprising all the alloying element in the ranges mentioned hereinabove or hereinafter.

An object, such as a tube or a seamless tube is manufactured through conventional processes including the steps of hot and cold working. Before the hot and cold working steps, a billet is manufactured by using, e.g. hot isostatic pressing (HIP).

The seamless tube and other objects obtained from the FeCrAl powder as defined hereinabove or hereinafter will operate well in high temperatures up to 1250° C. Furthermore, the present object will have a significant high-temperature corrosion resistance and a high resistance against oxidation, sulphurization and carburization. Additionally, the tube will have significant high-temperature creep strength, form stability and high electrical resistivity and ductility. The tube is especially useful as an electrical heating element or as a component in high temperature applications.

According to the present disclosure, the tube may be a hot worked tube or a hot worked and cold worked tube, such as a hot worked and cold rolled tube.

The invention is further described by the following non-limiting examples

EXAMPLES

Powders (Table 1A) with the chemical composition in wt % according to Table 1 were produced using gas atomization and then sieved to suitable fraction so that powders with particle size of less than 750 μm were obtained. Powder 1 and Powder 2 are powders within the present disclosure.

TABLE 1A

| | Powder 1 | Powder 2 | Ref powder |
|---|---|---|---|
| C | 0.031 | 0.034 | 0.035 |
| Si | 0.29 | 0.24 | 0.36 |
| Mn | 0.16 | 0.16 | 0.18 |
| Cr | 21.17 | 20.93 | 20.82 |
| Ni | 0.19 | 0.16 | 0.16 |
| Ti | 0.03 | 0.08 | 0.03 |
| Al | 4.90 | 4.84 | 5.08 |
| Mo | 0.03 | 0.01 | 2.94 |
| Fe | Bal. | Bal. | Bal. |
| Ta | 0.09 | 0.03 | 0.19 |
| Nb | 0.01 | 0.01 | 0.02 |
| Zr | 0.16 | 0.11 | 0.12 |
| Y | 0.06 | 0.02 | 0.15 |
| Hf | 0.19 | 0.19 | 0.23 |
| O | 0.025 | 0.020 | 0.025 |
| N | 0.054 | 0.056 | 0.054 |

TABLE 1B

| The condition: 2*[Y]-3*[O] < 0 | | | | |
|---|---|---|---|---|
| | Y [at %] | O [at %] | 2*[Y]-3*[O] | <0 |
| Powder 1 | 0.033 | 0.080 | −0.17 | Yes |
| Powder 2 | 0.012 | 0.065 | −0.17 | Yes |
| Ref powder | 0.089 | 0.082 | −0.07 | Yes |

The powders (see Table 1A) were HIP:ed with 3 h holding time at 1150° C. and 100 MPa pressure followed by a slow cooling to extrusions billets with a dimension of ø121 mm. From the extrusion billets were sample pieces taken to be used for the Gleeble testing (see Table 2)

Gleeble Tests were Performed Accordingly:

Tensile test specimens are heated to a set temperature with a specific heating profile/rate which are measured by thermocouples in a Gleeble system (Gleeble instrument). The set temperature can be reached by heating to desired temperature (ONH), or by cooling from a higher temperature (ONC). After a specified holding time at the desired temperature tensile tests are conducted by applying a tensile displacement rate of 50 mm/s on a cylindrical specimen having a 40 mm long reduced section. The area reduction of the tensile specimen at the fracture point is then measured which provides a measurement of the hot ductility. The result is shown in Table 2.

TABLE 2

| Temperature (° C.) | Mode | Ref Powder Area reduction (%) | Powder 1 Area reduction (%) | Powder 2 Area reduction (%) |
|---|---|---|---|---|
| 1300 | ONH | 81.81 | 95.91 | 98.98 |
| 1250 | ONH | 84.17 | 92.52 | 97.24 |
| 1200 | ONC | 75.59 | 93.86 | 97.4 |
| 1150 | ONC | 72.44 | 92.52 | 96.54 |
| 1100 | ONC | 77.17 | 91.81 | 93.54 |
| 1050 | ONC | 72.36 | 88.43 | 92.05 |
| 1000 | ONC | 46.93 | 86.77 | 92.05 |
| 900 | ONC | 57.09 | 78.82 | 81.26 |
| 800 | ONC | 31.57 | 62.99 | 64.65 |
| 700 | ONC | 5.75 | 37.01 | 45.59 |
| 600 | ONC | | 16.77 | 31.26 |
| 500 | ONC | | 11.26 | 22.05 |
| 400 | ONC | | 3.86 | 24.41 |

The hot tensile tests conducted in a Gleeble system consistently shows improved area reduction values for all evaluated test temperatures. Furthermore, the Inventive Powder 1 and 2 remain ductile to significantly lower temperatures. The conclusion from these results is that the ductility for Inventive Powder 1 and 2 are much greater compared to Ref Powder. This is very surprising because, without being bound to any theory, it is believed that this is due to the relationship between yttrium and oxygen. Further, it is surprising that even though Inventive Powder 1 and 2 only contain trace amounts of Mo as an impurity, the material properties are still good.

The invention claimed is:

1. A FeCrAl powder comprising the following elements in weight %;

| Balance | Fe and unavoidable impurities |
|---|---|
| Al | 4.0 to 6.0 |
| Y | 0.01 to 0.02 |
| Hf | 0.05 to 0.25 |
| O | 0.01 to 0.04 |
| Cr | 19.0 to 23.0 |
| Ta | 0.01 to 0.40 |
| Ti | 0.01 to 0.15 |
| C | 0.01 to 0.05 |
| N | 0.01 to 0.10 |
| Si | Max 0.50 |
| Mn | Max 0.30 |
| Zr | 0.05 to 0.20 |

and fulfilling the requirement of:

$2*[Y]-3*[O]<0$, wherein the numbers of [Y] and [O] are in atom %.

2. The powder according to claim 1, having a composition of:

| Balance | Fe and unavoidable impurities |
|---|---|
| Al | 4.0 to 6.0 |
| Y | 0.01 to 0.02 |
| Hf | 0.05 to 0.25 |
| O | 0.01 to 0.03 |
| Cr | 19.0 to 23.0 |
| Ta | 0.01 to 0.20 |
| Ti | 0.01 to 0.10 |
| C | 0.01 to 0.05 |
| N | 0.01 to 0.10 |
| Si | Max 0.50 |
| Mn | Max 0.30 |
| Zr | 0.05 to 0.20 |

and fulfilling the requirement of:

$2*[Y]-3*[O]<0$ wherein the number of [Y] and [O] are in atom %.

3. The powder according to claim 1, wherein the Cr content is from 20 to 22 wt %.

4. The powder according to claim 1, wherein the Al content is from 4.5 to 5.5 wt %.

5. The powder according to claim 1, wherein the content of N is from 0.02 to 0.08 wt %.

6. The powder according to claim 1, wherein the content of Ta is 0.01 to 0.20 wt %.

7. The powder according to claim 1, wherein $2*Y-3*O<-0.10$.

8. The powder according to claim 1, wherein the content of N is from 0.02 to 0.06 wt %.

9. The powder according to claim 1, wherein the content of Ta is 0.01 to 0.10 wt %.

10. The powder according to claim 1, wherein $2*Y-3*O<-0.15$.

11. The powder according to claim 1, wherein the FeCrAl powder has a particle size of less than 750 microns.

12. The powder according to claim 1, wherein the Cr content is from 20 to 22 wt %,
wherein the Al content is from 4.5 to 5.5 wt %,
wherein the content of N is from 0.02 to 0.08 wt %,
wherein the content of Ta is 0.01 to 0.20 wt %, and
wherein $2*Y-3*O<-0.10$.

13. The powder according to claim 1, wherein the Cr content is from 20 to 22 wt %,
wherein the Al content is from 4.5 to 5.5 wt %,
wherein the content of N is from 0.02 to 0.06 wt %,
wherein the content of Ta is 0.01 to 0.10 wt %, and
wherein $2*Y-3*O<-0.15$.

14. The powder according to claim 13, wherein the FeCrAl powder has a particle size of less than 750 microns.

15. The powder according to claim 2, wherein the Cr content is from 20 to 22 wt %,
wherein the Al content is from 4.5 to 5.5 wt %,
wherein the content of N is from 0.02 to 0.08 wt %, and
wherein $2*Y-3*O<-0.10$.

16. The powder according to claim 2, wherein the Cr content is from 20 to 22 wt %,
wherein the Al content is from 4.5 to 5.5 wt %,
wherein the content of N is from 0.02 to 0.06 wt %,
wherein the content of Ta is 0.01 to 0.10 wt %, and
wherein $2*Y-3*O<-0.15$.

17. The powder according to claim 16, wherein the FeCrAl powder has a particle size of less than 750 microns.

* * * * *